US007021425B2

(12) United States Patent
Noguchi et al.

(10) Patent No.: US 7,021,425 B2
(45) Date of Patent: Apr. 4, 2006

(54) CLOSED TYPE ELECTRIC COMPRESSOR

(75) Inventors: Kazuhito Noguchi, Kanagawa (JP); Akihiko Kubota, Kanagawa (JP); Masahiko Osaka, Kanagawa (JP); Manabu Motegi, Saitama (JP); Hidetoshi Nishihara, Kanagawa (JP)

(73) Assignee: Matsushita Refrigeration Company, Shiga (JP)

( * ) Notice: Subject to any disclaimer, the term of this patent is extended or adjusted under 35 U.S.C. 154(b) by 140 days.

(21) Appl. No.: 10/276,942

(22) PCT Filed: May 30, 2001

(86) PCT No.: PCT/JP01/04546

§ 371 (c)(1),
(2), (4) Date: Mar. 27, 2003

(87) PCT Pub. No.: WO01/92724

PCT Pub. Date: Dec. 6, 2001

(65) Prior Publication Data

US 2003/0161741 A1 Aug. 28, 2003

(30) Foreign Application Priority Data

May 30, 2000 (JP) ..... 2000-159868

(51) Int. Cl.
*F04C 29/02* (2006.01)

(52) U.S. Cl. ..... 184/6.16; 418/88

(58) Field of Classification Search ..... 184/6.16, 184/6.18; 418/88, 94
See application file for complete search history.

(56) References Cited

U.S. PATENT DOCUMENTS

| | | | | |
|---|---|---|---|---|
| 3,545,891 | A * | 12/1970 | Parker | 417/372 |
| 3,858,685 | A * | 1/1975 | Bono | 184/6.16 |
| 4,865,527 | A * | 9/1989 | Piera et al. | 417/368 |
| 5,060,759 | A * | 10/1991 | Dussourd et al. | 184/6.2 |
| 5,762,164 | A * | 6/1998 | Krueger et al. | 184/6.18 |
| 5,884,727 | A * | 3/1999 | Ryu | 184/6.3 |
| 6,116,877 | A * | 9/2000 | Takeuchi et al. | 418/88 |
| 6,182,794 | B1 * | 2/2001 | Lee | 184/6.18 |
| 2001/0050200 | A1 * | 12/2001 | Oh | 184/6.16 |

FOREIGN PATENT DOCUMENTS

| | | |
|---|---|---|
| JP | 8-270562 | 10/1996 |
| JP | 11-303748 | 11/1999 |

OTHER PUBLICATIONS

International Search Report for PCT/JP01/04546 dated Aug. 21, 2001.
English translation of PCT/ISA/210.

* cited by examiner

*Primary Examiner*—Chong H. Kim
(74) *Attorney, Agent, or Firm*—RatnerPrestia

(57) ABSTRACT

A sealed electric compressor for use in, for example, an electric refrigerator, generates a little noise and can feed any moving part of its compressing element with refrigerator lubricant. An oil pickup tube is joined by insertion to the lowermost end of a crank shaft and includes a first centrifugal pumping portion and a second centrifugal pumping portion provided continuously and arranged at a smaller angle than that of the first centrifugal pumping portion. The second centrifugal pumping portion arranged at a smaller angle can spin in a pool of the refrigerator lubricant.

7 Claims, 6 Drawing Sheets

CLOSED TYPE ELECTRIC COMPRESSOR

This application is a U.S. national phase application of PCT International Application PCT/JP01/04546.

TECHNICAL FIELD

The present invention relates to a sealed electric compressor for use in, for example, an electric refrigerator.

BACKGROUND ART

Sealed electric compressors (referred to as compressors hereinafter) designed for emitting small operating noise have been modified to reduce noise generated in its interior as being demanded worldwide.

A conventional compressor will be explained referring to the relevant drawings.

The conventional compressor is illustrated in FIGS. 5 and 6. A motor element 53 is provided over a compression element 52 elastically supported in an enclosure container 51. A crank shaft 54 is driven by the motor element 53 for rotating motions, and is joined at the lowermost end to an oil pickup tube 55. The enclosure container 51 accommodates an amount of refrigerator lubricant oil 56 for the compression element loaded therein.

An operation of the conventional compressor having the above arrangement will be explained.

The oil pickup tube 55 includes a centrifugal pumping portion 55*a* joined to the lowermost end of the crank shaft 54 rotating with the motor element 53 and a concentric spinning portion 55*b* arranged continuously of the centrifugal pumping portion 55*a*. When the tube 55 is driven, the concentric spinning portion 55*b* only spins in the refrigerator lubricant oil 56 in the enclosure container 51. This reduces a resonance noise generated with the oil pickup tube 55 which vibrates across the oil level during the spinning.

However, since the concentric spinning portion 55*b* spins in the refrigerator lubricant oil 56 in the enclosure container 51, the portion 55*b* generates a little centrifugal force at the opening end 61. The little force keeps a lifting stroke low, thus decreasing a the pumping amount of the lubricant oil.

SUMMARY OF THE INVENTION

In a compressor, each moving part of a compressing element is lubricated while reducing stirring of a refrigerator lubricant with an oil pickup tube.

The compressor includes the oil pickup tube communicated at one open end to a lubricant aperture provided in an eccentric axis portion of a crank shaft, and at the other open end to a pool of the refrigerator lubricant across the axis of revolution of a main shaft portion of the crank shaft. The oil pickup tube includes a first centrifugal pumping portion and a second centrifugal pumping portion located beneath the first centrifugal pumping portion and tilted from the axis of revolution of the crank shaft by an angle which is smaller than that of the first centrifugal pumping portion.

The refrigerator lubricant is prevented from being stirred by the first centrifugal pumping portion arranged at a greater angle. This reduces skipping and splashing noises as well as a resonant noise from the oil pickup tube, and simultaneously ensures lubricating every moving part of compressing element.

DETAILED DESCRIPTION OF THE PREFERRED EMBODIMENTS

An exemplary embodiment of the present invention will be described referring to FIGS. 1 to 4. Like components are denoted by like numerals as those of the conventional compressor and will be explained in no more detail.

Figure 1:
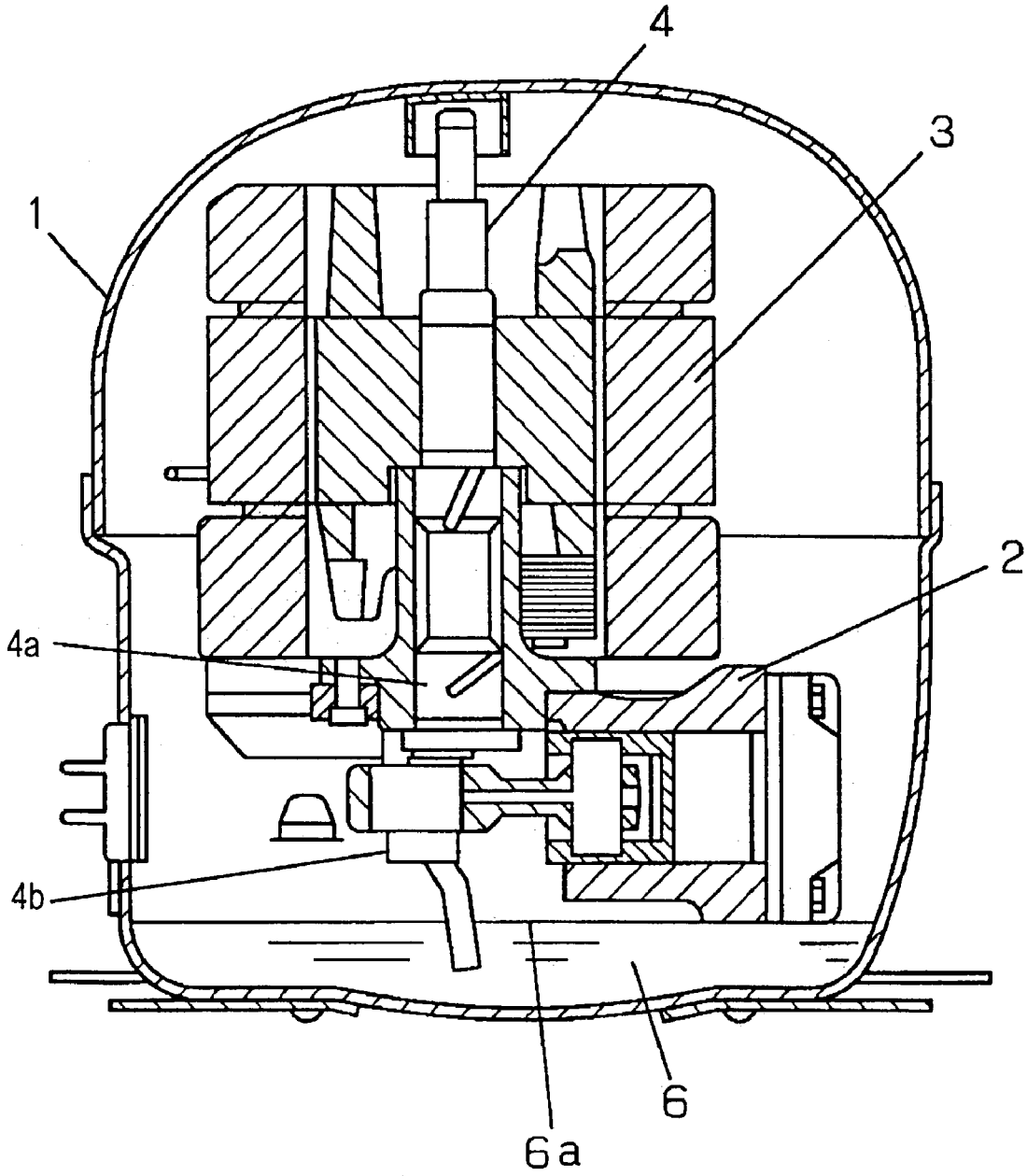
FIG. 1 is a longitudinally cross sectional view of a compressor according to an exemplary embodiment of the present invention.
Figure 2:
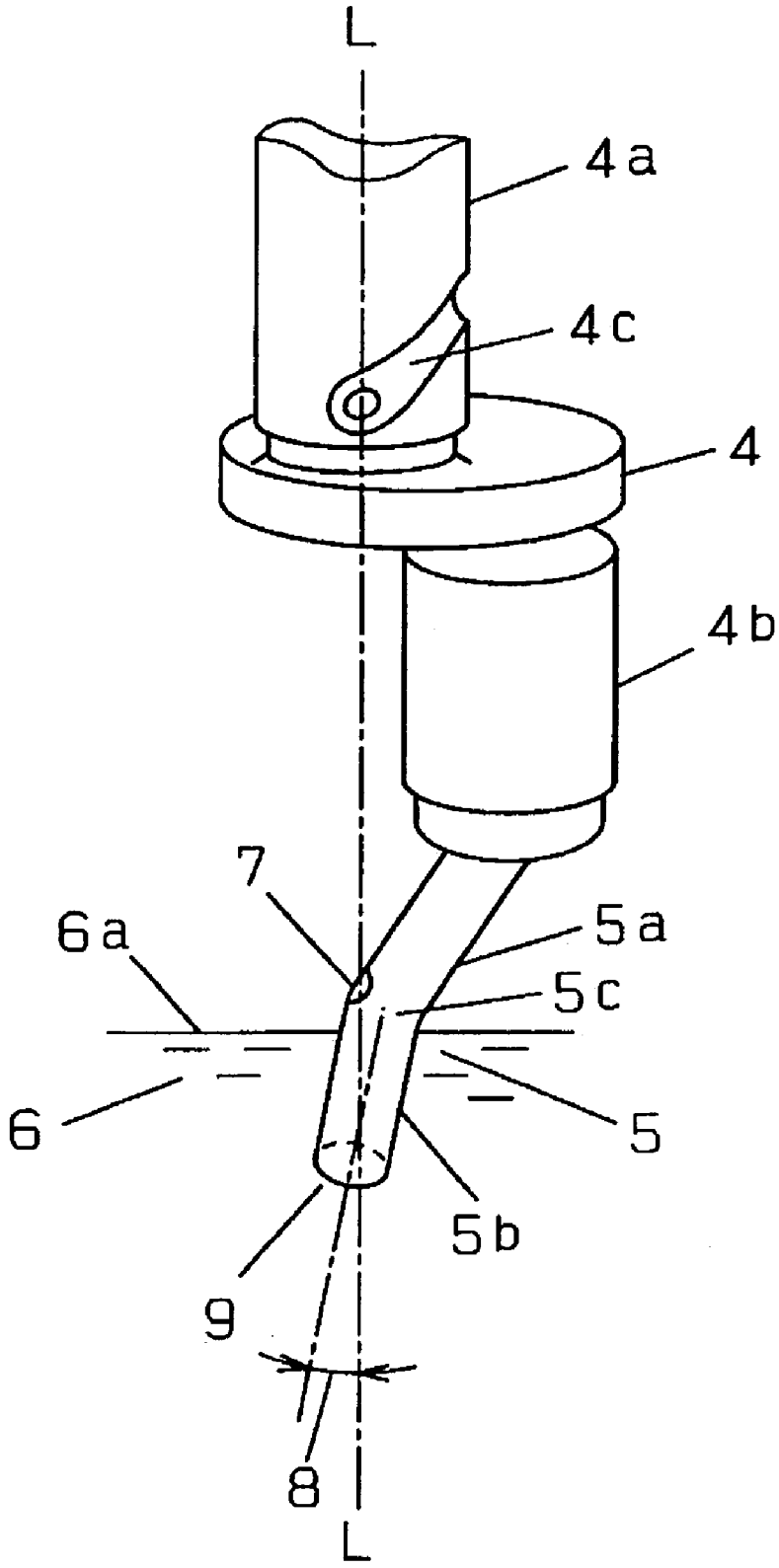
FIG. 2 is a perspective view of a primary part of the compressor of the embodiment.
Figure 3:
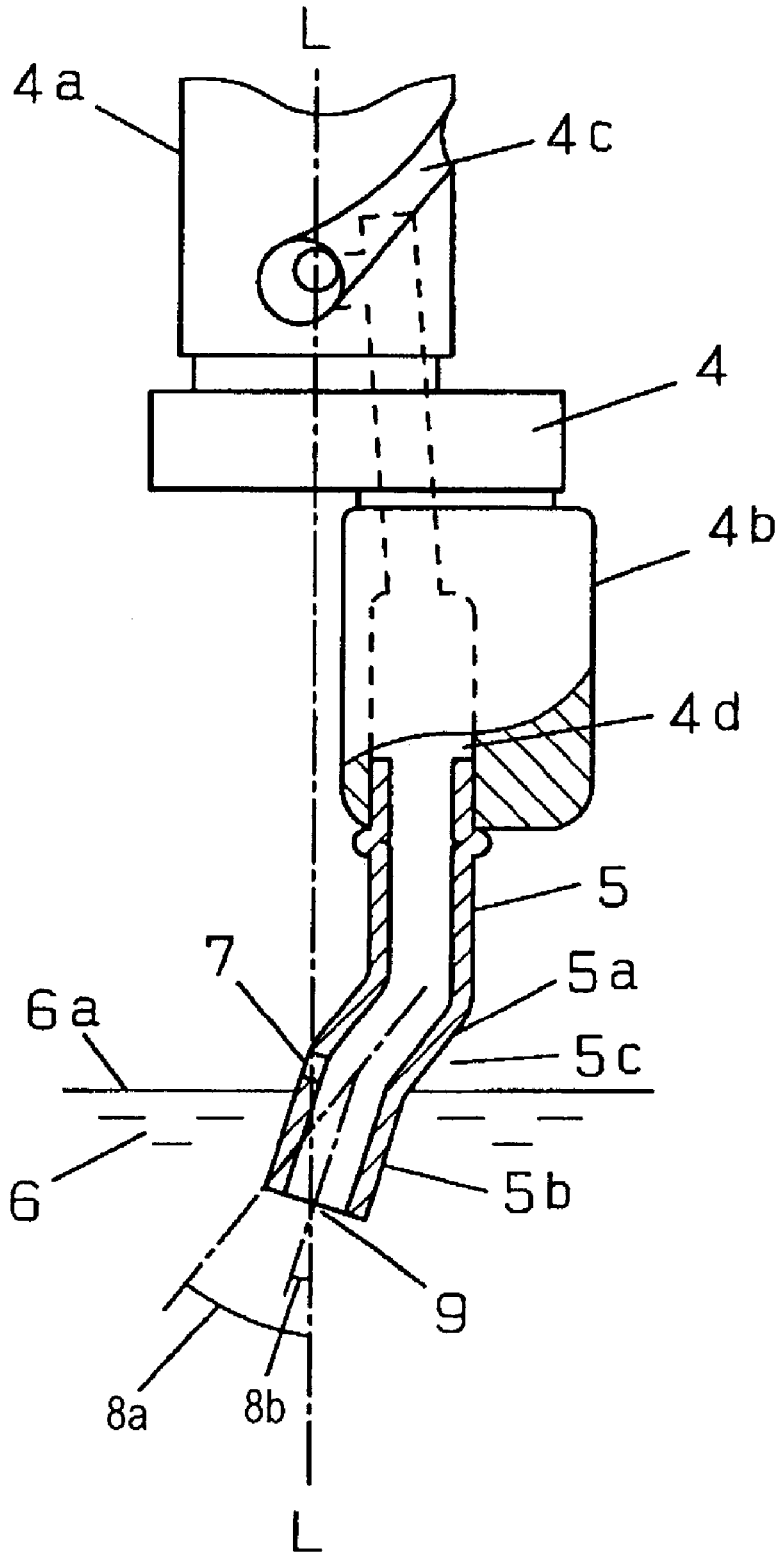
FIG. 3 is a longitudinally cross sectional view of the primary part of the compressor of the embodiment.

FIG. 1 is a longitudinally cross sectional view of the compressor of the embodiment. FIG. 2 is a perspective view of a primary part of the compressor. FIG. 3 is a longitudinally cross sectional view of the primary part of the compressor.

As shown in FIG. 1 to FIG. 3, the compressor includes an enclosure container 1, a compression element 2, and a motor element 3. A crank shaft 4 includes a main shaft portion 4*a* and an eccentric shaft portion 4*b* beneath the main shaft portion 4*a*. An oil pickup tube 5 includes a first centrifugal pumping portion 5*a* and a second centrifugal pumping portion 5*b* beneath the first centrifugal pumping portion 5*a*, and is joined to a lubricant aperture 4*d* in the eccentric shaft portion 4*b* of the crank shaft 4. The first centrifugal pumping portion 5*a* and the second centrifugal pumping portion 5*b* are arranged at two different angles 8*a* and 8*b*, respectively, against the rotation axis L—L of the crank shaft 4. The angles 8*a* and 8*b* satisfy $8a \leqq 8b$. A refrigerator lubricant 6 for the compression element is introduced into and stays at the bottom in the interior of the enclosure container 1. The oil pickup tube 5 has a gas vent 7 provided at a bent portion thereof across the rotation axis which is located at the lowermost end of the first centrifugal pumping portion 5*a* and at the uppermost end of the second centrifugal pumping portion 5*b* thereof. The oil pickup tube 5 has an opening 9 provided at the lowermost end of the second centrifugal pumping portion 5*b*. The opening 9 is submerged in the refrigerator lubricant 6 pooled at the bottom in the interior of the enclosure container 1.

As being driven by the motor element 3, the crank shaft 4 spins the oil pickup tube 5 joined to its lowermost end. Meanwhile, the level 6*a* of the refrigerator lubricant 6 remains lower than the bend 5*c* across the rotation axis of the oil pickup tube 5. This allows the oil pickup tube 5 to spin with the first centrifugal pumping portion 5*a* at the greater angle 8*a* against the rotation axis of the crank shaft 4 staying above the lubricant level 6*a*. The second centrifugal pumping portion 5*b* at the smaller angle 8*b* against the rotation axis of the crank shaft 4 is submerged in the refrigerator lubricant 6. As the result, the effect of the pumping potion 5 moving across the lubricant level will be eased hence reducing the skipping and splashing of the refrigerator lubricant 6. Accordingly, the noise generated by the movement across the lubricant level of the pumping portion 5*b* splashing the refrigerator lubricant 6 will be declined. Since the oil pickup tube 5 vibrates less, its resultant resonance will be declined, thus reducing the noise.

In lubrication tests where the angle 8*b* of the second centrifugal pumping portion 5*b* to the rotation axis is regarded as a parameter and set to four degrees, the lubricant was fed at 10 $cm^3$/min at 50 Hz or 20 $cm^3$/min at 60 Hz when the lubricant level 6*a* was declined. With the angle 8*b* is five degrees or greater, the lubricant was fed at 20 $cm^3$/min at 50 Hz and 30 $cm^3$/min at 60 Hz even when the lubricant level 6*a* was declined. Accordingly, with the angle 8*b* of five degrees or greater, the refrigerator lubricant 6 was fed to the first centrifugal pumping portion 5*a* without declining the pumping capability of the second centrifugal pumping portion 5*b* of oil pickup tube 5 even if the level 6*a* of the lubricant 6 is lowered.

In a noise test using the angle 8*b* as a parameter, a noise at the oil pickup tube 5 declined by 3 dB at a resonant frequency range from 5 to 6.3 kHz when the angle 8*b* was not greater than 15°. The noise increased when the angle 8*b* exceeded 16°. Therefore, the angle 8*b* not greater than 15° suppresses the stirring of the refrigerator lubricant 6 with the second centrifugal pumping portion 5*b*, and hence reduces the skipping and splashing of the lubricant 6 by the spinning movement of the oil pickup tube 5 to reduce a generated noise.

The refrigerator lubricant 6 generally contains 3 to 5% of refrigerant gas. Since the lubricant 6 is stirred during flowing through the oil pickup tube 5, the lubricant 6 releases a fair amount of the refrigerant gas which may interrupt the flow of the refrigerator lubricant 6 and thus disturb the lubrication. This interrupting is the most at the bent 5*c* of the oil pickup tube 5 where the tilting angle increases. The gas vent 7 is provided in the bent 5*c* of the oil pickup tube 5 for discharging the refrigerant gas. Accordingly, since the flowing of the refrigerator lubricant 6 is prevented from being interrupted by the refrigerant gas, the compressor has an improved operational reliability.

Figure 4:
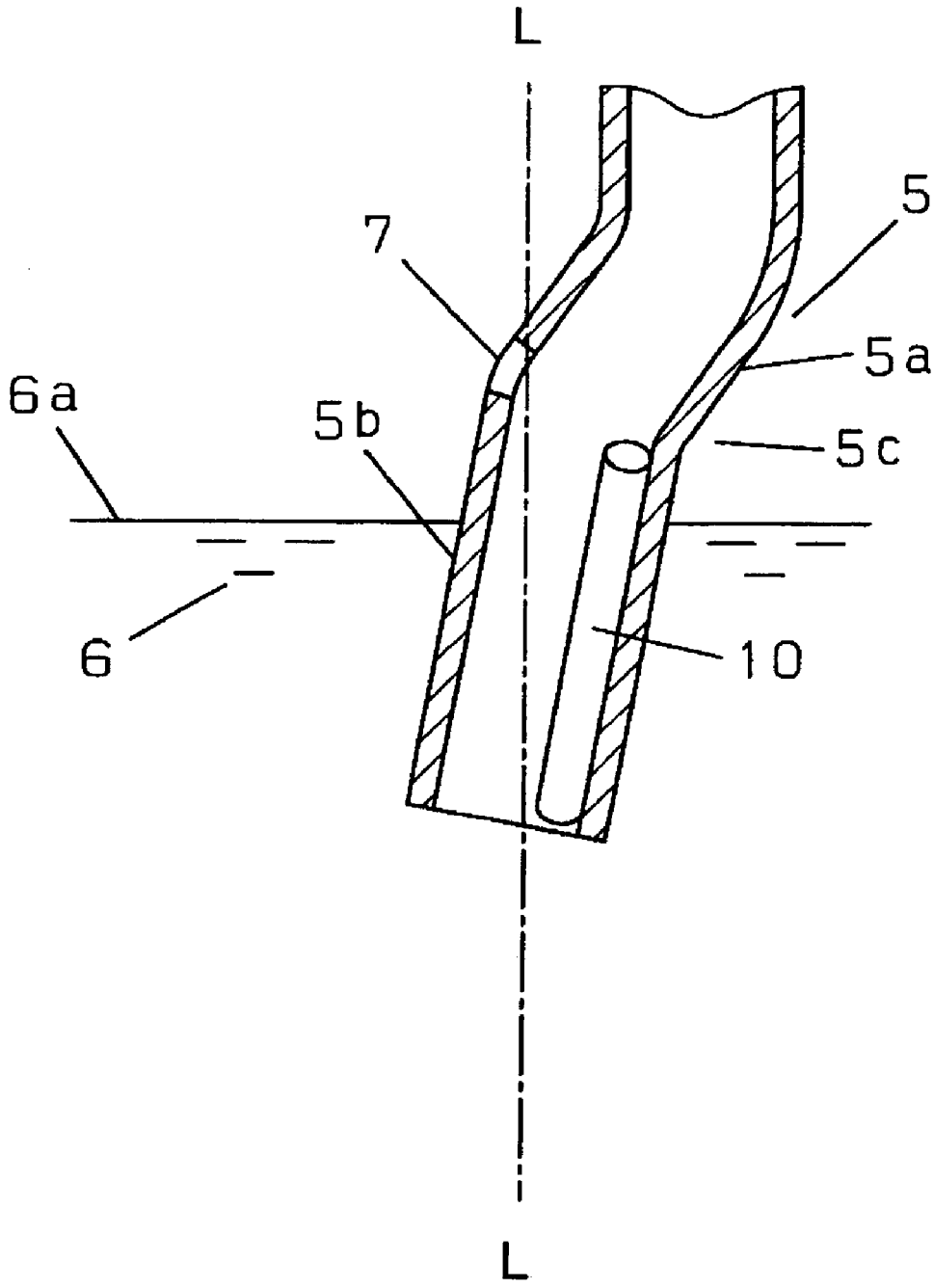
FIG. 4 is a longitudinally cross sectional view of another oil pickup tube in the compressor of the embodiment.
Figure 5:
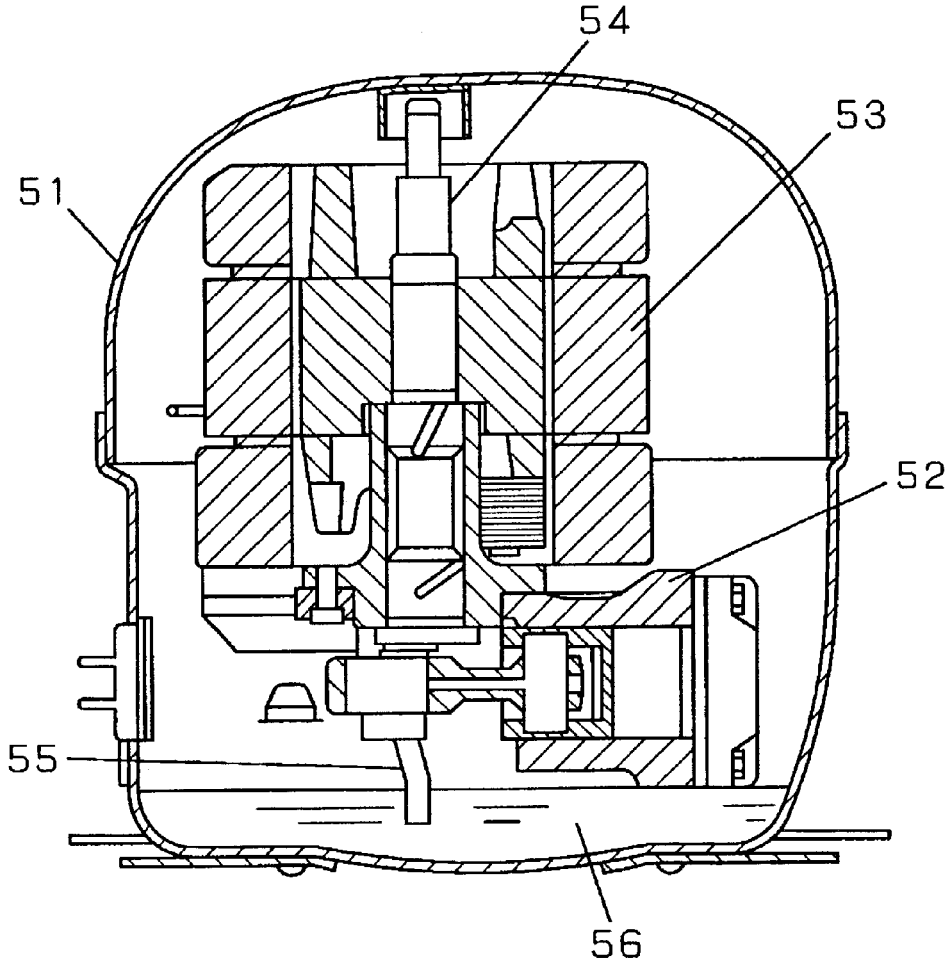
FIG. 5 is a longitudinally cross sectional view of a conventional compressor.
Figure 6:
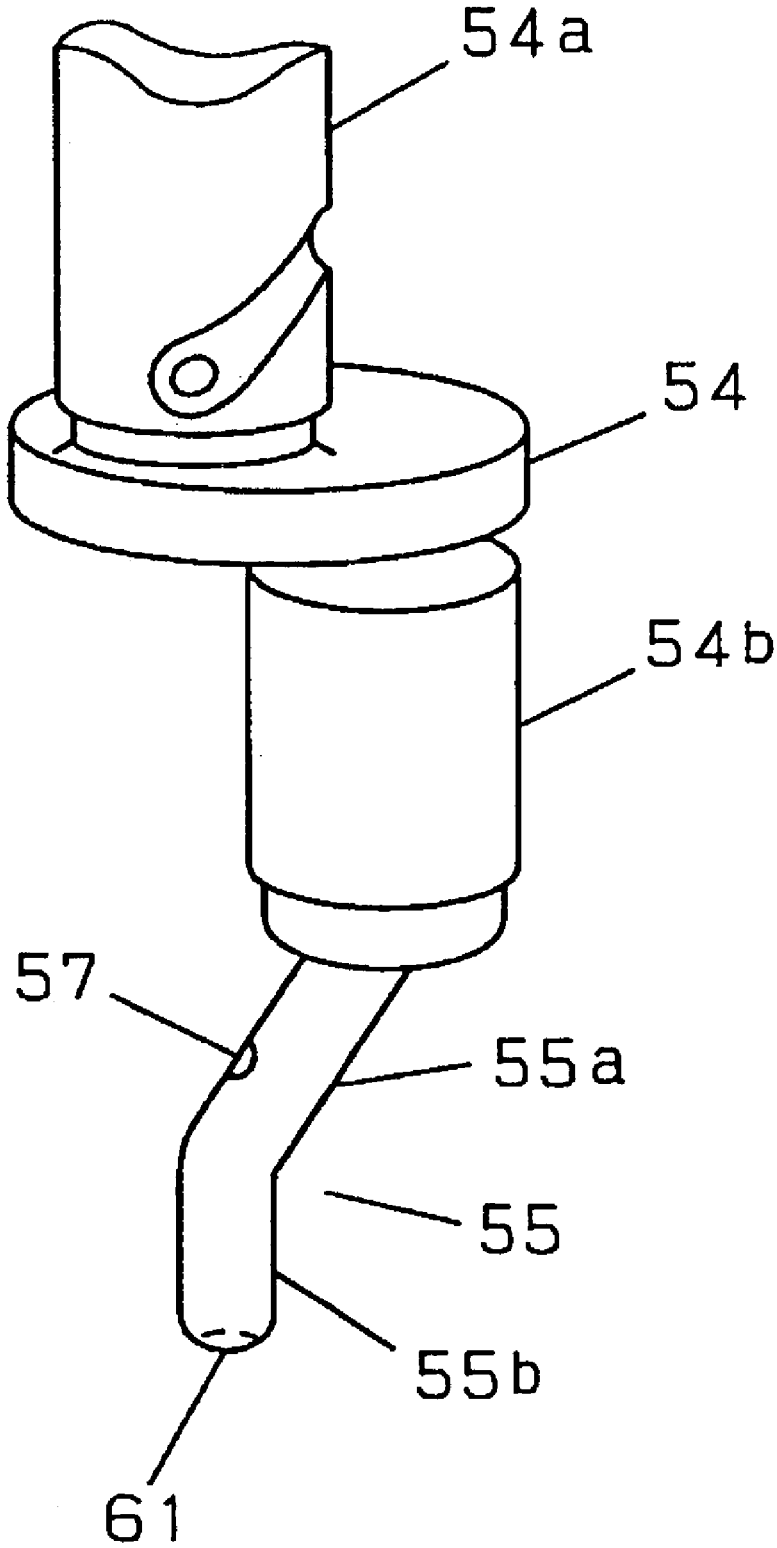
FIG. 6 is a perspective view of a primary part of the conventional compressor.

Moreover, a cylindrical bar 10 attached by projection welding or the like is jointed to the inner wall at a location further from the rotation axis L—L of the second centrifugal pumping portion 5*b* of the oil pickup tube 5, as shown in FIG. 4.

The feed of the lubricant is proportional to a square of the spinning speed and the degree of eccentricity of the oil pickup tube 5. The eccentricity is substantially determined by the distance between the rotation axis of the crank shaft 4 and the refrigerator lubricant 6 at the inner wall of the second centrifugal pumping portion 5*b*. However, the refrigerator lubricant 6 at the inner wall of the second centrifugal portion 5*b* may shift due to a counter action in a reverse of the spinning direction of the oil pickup tube 5, thus significantly reducing the degree of eccentricity. The cylindrical bar 10 prevents the refrigerator lubricant 6 from shifting in the reverse of the spinning direction. Since the refrigerator lubricant 6 at the inner wall of the second centrifugal pumping portion 5*b* remains in the spinning direction during the movement, thus maintaining the degree of eccentricity, the compressor can be more improved in the pumping capability and thus the operational reliability.

The cylindrical bar 10 may be attached at a proper angle to the spinning direction of the oil pickup tube 5 by projection welding or the like. This allows the refrigerator lubricant 6 to run upwardly along the inner wall of the second centrifugal pumping portion 5*b* in the spinning direction of the oil pickup tube 5, thus further improving the pumping capability of the compressor.

INDUSTRIAL APPLICABILITY

The present invention relates to a sealed electric compressor for use in an electric refrigerator. The compressor includes an oil pickup tube including the first centrifugal pumping portion and the second centrifugal pumping portion arranged at a smaller angle to the axis of the crank shaft than that of the first centrifugal pumping portion. While its stirring being suppressed, the refrigerator lubricant is fed to the first centrifugal pumping portion by the centrifugal pumping action of the second centrifugal pumping portion for distribution to every moving part of the compression element. Since the skipping and splashing of the refrigerator lubricant caused by the spinning of the oil pickup tube is suppressed, a generated noise can be reduced. Since the oil pickup tube is attenuated in the vibration, a resonant noise can be reduced.

The invention claimed is:

1. A sealed electric compressor comprising:

an enclosed container in which a pool of refrigerator lubricant is provided;

a motor element located in said enclosed container;

a crank shaft driven by said motor element, said crank shaft rotating about a main axis including a main shaft portion and an eccentric shaft portion, said eccentric shaft portion having a lubricant aperture provided therein and being joined to said main shaft portion; and an oil pickup tube having an open end communicating to said lubricant aperture of said crank shaft and another open end in said pool of said refrigerator lubricant, said oil pickup tube rotated by said crank shaft as said crank shaft is driven by said motor element, wherein said oil pickup tube comprises a first centrifugal pumping portion having a first central axis and a second centrifugal pumping portion having a second central axis located beneath said first centrifugal pumping portion, wherein an angle between said first central axis and said main axis is greater than zero, wherein an angle between said second central axis and said main axis is greater than zero, and wherein said angle between said first central axis and the second central axis is greater than said angle between said second central axis and said main axis.

2. The sealed electric compressor according to claim 1, wherein said angle between said second central axis and said main axis is from 5° to 15°.

3. The sealed electric compressor according to claim 1, wherein substantially only said second centrifugal pumping portion of said oil pickup tube is submerged at one end in said pool of said refrigerator lubricant.

4. The sealed electric compressor according to claim 1, wherein said oil pickup tube has a gas vent provided at a bent thereof between said first centrifugal pumping portion and said second centrifugal pumping portion across said rotation axis of said main shaft portion of said crank shaft.

5. The sealed electric compressor according to claim 1, further comprising a bar attached to an inner wall of said second centrifugal pumping portion of said oil pickup tube.

6. The sealed electric compressor according to claim 5, wherein said bar has a cylindrical shape.

7. The sealed electric compressor according to claim 1, said another open end of said oil pickup tube opens on a rotation axis of said main shaft portion of said crank shaft.

* * * * *